US006924768B2

(12) United States Patent
Wu et al.

(10) Patent No.: US 6,924,768 B2
(45) Date of Patent: Aug. 2, 2005

(54) PRINTED ANTENNA STRUCTURE

(75) Inventors: Min-Chuan Wu, TaiChung (TW); Peng-Yuan Kuo, Hsinchu (TW); Shyh-Jong Chung, Hsinchu (TW); Chih-Min Lee, Hsinchu (TW)

(73) Assignee: Realtek Semiconductor Corp., Hsinchu (TW)

( * ) Notice: Subject to any disclaimer, the term of this patent is extended or adjusted under 35 U.S.C. 154(b) by 5 days.

(21) Appl. No.: 10/442,074

(22) Filed: May 21, 2003

(65) Prior Publication Data

US 2003/0218572 A1 Nov. 27, 2003

(30) Foreign Application Priority Data

May 23, 2002 (TW) ..... 91111153 A

(51) Int. Cl.[7] ..... H01Q 1/24

(52) U.S. Cl. ..... 343/702; 343/700 MS; 343/745

(58) Field of Search ..... 343/702, 700 MS, 343/783, 745, 749, 873; H01Q 1/24

(56) References Cited

U.S. PATENT DOCUMENTS

| | | | | |
|---|---|---|---|---|
| 6,008,774 | A * | 12/1999 | Wu | 343/828 |
| 6,747,600 | B2 * | 6/2004 | Wong et al. | 343/700 MS |
| 2004/0017315 | A1 * | 1/2004 | Fang et al. | 343/700 MS |
| 2004/0027295 | A1 * | 2/2004 | Huber et al. | 343/702 |

* cited by examiner

*Primary Examiner*—Hoanganh Le
(74) *Attorney, Agent, or Firm*—Troxell Law Office, PLLC

(57) ABSTRACT

The present invention discloses a printed antenna structure. The printed antenna structure comprises: a dielectric layer having opposed surfaces, a ground plane layer covered on the first surface of the dielectric layer, a feed-line extending over the second surface of the dielectric layer and connecting to a driving circuitry, a primary radiating element connected to the feed-line and not extending over to the ground plane layer, and a tuning element connected to the primary radiating element and not extending over to the ground plane layer for adjusting the radiating frequency. The timing element her comprises two stubs each having a free end spaced apart from each other and a fixed end connected to the primary radiating element so as to reduce the overall length of the printed antenna.

12 Claims, 12 Drawing Sheets

Eϕ in X-Y plane

Eθ in X-Y plane

Eϕ in X-Z plane

Eθ in X-Z plane

Eϕ in Y-Z plane

Eθ in Y-Z plane

Return Loss of single antenna

PRINTED ANTENNA STRUCTURE

BACKGROUND OF THE INVENTION

1. Field of the Invention

The present invention generally relates to a printed antenna structure and, more particularly, to a printed antenna structure having a V-shaped tuning element.

2. The Description of the Prior Art

The rapid development of personal computer coupled with users desires to transmit data between personal computers has resulted in the rapid expansion of local area networks. Today, local area network has been widely implemented in many places such as in home, public access, and working place. However, the implementation of local area network has been limited by its own nature. The most visible example of the limitation is the cabling. One solution to this problem is to provide personal computer with a wireless network interface card to enable the personal computer to establish a wireless data communication link. Using a wireless network interface card, a personal computer, such like a notebook computer, can provide wireless data transmission with other personal computers or with a host computing device such like a server connected to a conventional wireline network.

The growth in wireless network interface cards, particularly in notebook computers, has made it desirable to enable personal computer to exchange data with other computing devices and has provided many conveniences to personal computer users. As a major portion of a wireless network interface card, the antenna has received many attentions of improvements, especially in function and size. FIG. 1 is showing a PCMCIA wireless network interface card used in a notebook computer. The card can be used with a PCMCIA slot built in a notebook computer, As shown, the wireless network interface card 8 comprises a main body 23, and an extension portion 12. The main body 23 further comprises driving circuitries, connectors, etc. The extension portion 12 comprises a printed antenna 10 for transmitting and receiving wireless signals. Presently, the antennas being used widely in a wireless network interface card include Printed Monopole Antenna, Chip Antenna, Inverted-F Antenna, and Helical Antenna. Among them, the Printed Monopole Antenna is simple and inexpensive. As shown in FIG. 2, a Printed Monopole Antenna 20 comprises a feed-line 21, a primary radiating element 22, a ground plane 24 and a dielectric material 25. The current on the Printed Monopole Antenna is similar to the one on a Printed Dipole Antenna, so the electric field being created will be the same. The difference is that the ground plane 24 of the Printed Monopole Antenna 20 will create mirror current, so the total length of the Printed Monopole Antenna 20 is only $\lambda_g/4$, which is half of a Printed Dipole Antenna. The improvement on the length of an antenna is significant in application for wireless network interface card. The definition of the wavelength $\lambda_g$ described above is $$\lambda_g = \frac{1}{\sqrt{\varepsilon_{rg}}} * \frac{c}{f_0}$$

Wherein c is the speed of light, $f_0$ is the center frequency of electromagnetic waves, and $\in_{re}$ is the equivalent dielectric constant and is between the nominal dielectric constant (around 4.4) of circuit board and the dielectric constant (around 1) of air. For example, if the center frequency is 2.45 GHz and the dielectric constant is 4.4, the length of the Printed Monopole Antenna will be 2.32 cm. Since the space in a wireless network interface card reserved for an antenna is limited, an antenna with such length will not be fit properly into a card, therefore, some modification for the antenna is required. In the U.S. Pat. No. 6,008,774 "Printed Antenna Structure for Wireless Data Communications", modification for such antenna is disclosed. As shown in FIG. 3, the shape of a Printed Monopole Antenna has been changed in order to reduce the size thereof. The concept of U.S. Pat. No. 6,008,774 is to bend the primary radiating element 22 of FIG. 2 into the form of a V-shaped primary radiating element 32 as shown in FIG. 3. Although the overall length of the primary radiating element 32 of U.S. Pat. No. 6,008,774 is still $\lambda_g/4$, however, the space needed for furnishing this modified primary radiating element 32 is reduced The antenna 30 shown in FIG. 3 also comprises a feed-line 31, the primary radiating element 32, a ground plane 34 and a dielectric material.

SUMMARY OF THE INVENTION

In view of these problems, it is the primary object of the present invention to provide an antenna having a V-shaped tuning element for reducing the size of the antenna.

In order to achieve the foregoing object, the present invention provides a printed antenna structure, which comprises a dielectric layer having two opposed surfaces; a ground plane layer covered on the first surface of the dielectric layer;, a feed-line extending over the second surface of the dielectric layer and connecting to a driving circuit; a primary radiating element connected to the feed-line and not extending over the ground plane layer; and a tuning element connected to the primary radiating element and not extending over the ground plane layer for tuning the radiating frequency. The shape of the primary radiating element can be linear, V-shaped or curve-shaped. The tuning element comprises two stubs both connected to the primary radiating element and each having a free end spaced apart from each other so as to reduce the overall length of the printed antenna.

Other and further features, advantages and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms.

BRIEF DESCRIPTION OF THE DRAWINGS

The objects, spirits and advantages of the preferred embodiments of the present invention will be readily understood by the accompanying drawings and detailed descriptions, wherein.

DETAILED DESCRIPTION OF THE INVENTION

The present invention discloses a printed antenna with tuning element, which can be exemplified by the preferred embodiments as described hereinafter.

Figure 4:
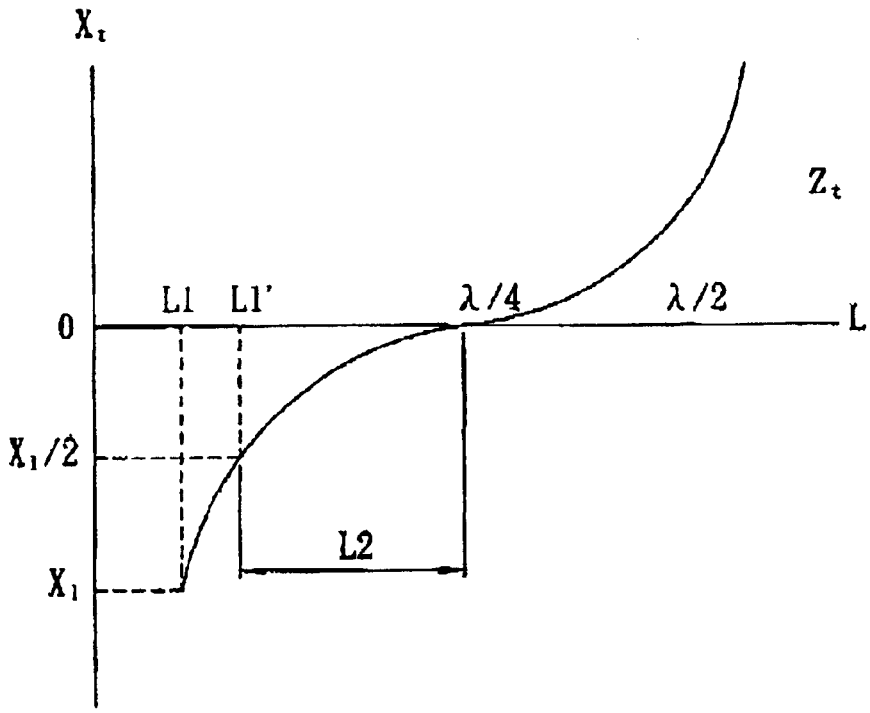
FIG. 4 is a diagram showing the relationship between the imaginary part $X_t$ of the input impedance and the length L of an open transmission line.

To a skilled in art, a dipole antenna having length of 2L can be regarded as the modification of an open transmission line having length of L. And the imaginary part ($jX_a$) of the input impedance ($R_a+jX_a$) of the dipole antenna is similar to the input impedance ($jX_t$) of the open transmission line, wherein $jX_t=-jZ_0 \cot(2\pi L/\lambda_g)$, and $Z_0$ is the characteristic impedance of the line. FIG. 4 is a diagram showing the relationship between the imaginary part $X_t$ of the input impedance and the length L of an open transmission line. To satisfy the requirement of resonance ($X_a \approx X_t=0$) for the antenna, the length L of the open transmission line should be one-fourth of the wavelength, that is, $L=\lambda_g/4$. The following explains how the present invention works. FIG. 4 is a diagram showing the relationship between the imaginary part $X_t$ of the input impedance and the length L of an open transmission line. In FIG. 4, assuming the input impedance $Z_1$ of the open transmission line having length L1 is $jX_1$ and the input impedance $z_1'$ of the open transmission line having length L1' is $$\frac{Z_1}{2} = \frac{jX_1}{2},$$

then L1<L1'. Therefore, as shown in FIG. 5, when two open lines, each having length of L1, being connected in parallel, so the input impedance $Z_1'$ becomes $$\frac{jX_1}{2},$$

meaning that the equivalent length of the open transmission lines will be L1'.

Figure 5:
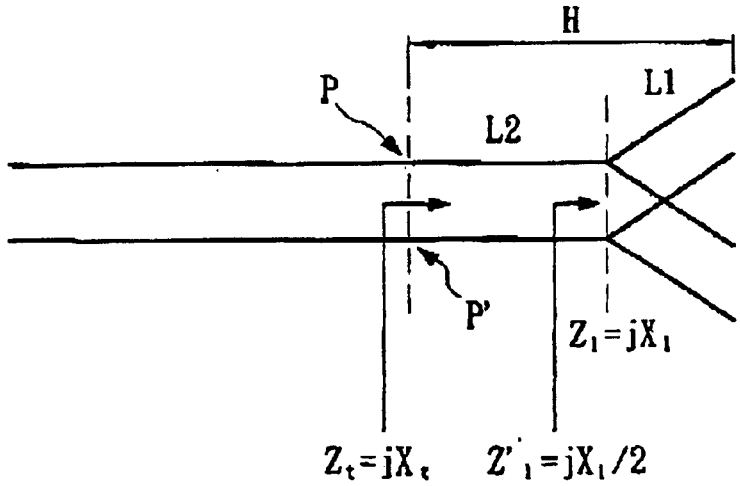
FIG. 5 is a diagram showing a transmission line of length $L_2$ loaded with two open transmission line each having a length of $L_2$ in parallel connection.
Figure 7:
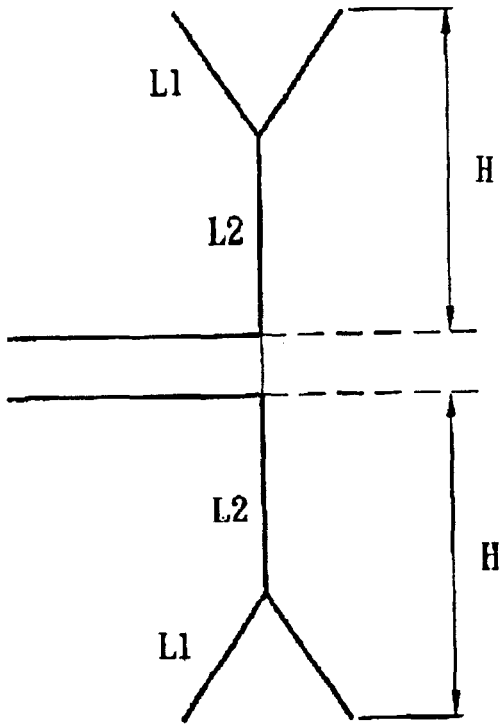
FIG. 7 is a schematic diagram showing a V-shaped dipole antenna.
Figure 8:
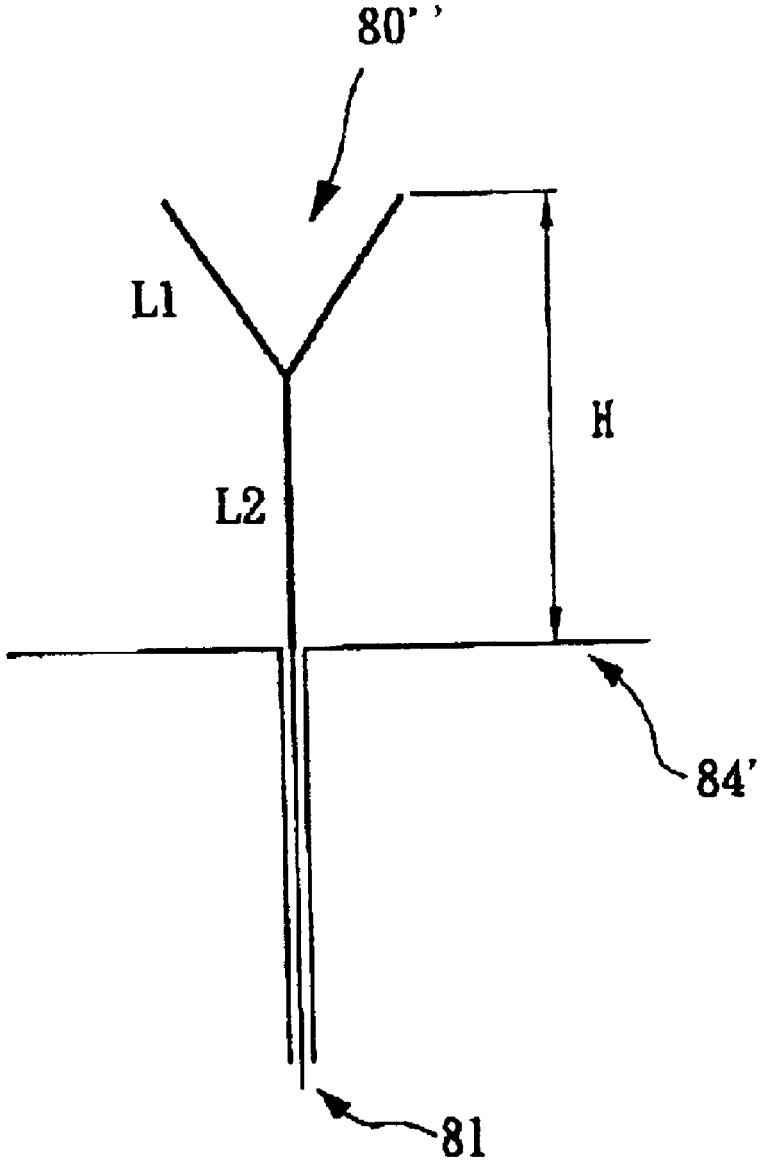
FIG. 8 is a schematic diagram showing a V-shaped monopole antenna.

Referring to FIG. 5, an additional line having length of L2 is added to the open transmission lines being connected in parallel. As explained above, the corresponding input impedance will be the same as that of the line having length of L1'+L2, that is, the input impedance shown in FIG. 5 & FIG. 6 will be the same. When resonance occurred, the input impedance is zero, the total length L1'+L2 of the line shown in FIG. 6 should be $$\frac{\lambda_g}{4},$$

and the length of the configuration shown in FIG. 5 satisfies the relation of $$H < L1 + L2 < L1' + L2 = \frac{\lambda_g}{4},$$

which means the resonance length of the configuration shown in FIG. 5 is shorter than that of an open transmission line. In FIG. 5, if the signal line and the ground line are bended up and down respectively at p–p', the antenna will become a Y-shaped dipole one. As shown in FIG. 7, the imaginary part $X_t$ of the input impedance of the Y-shaped dipole antenna is similar to the input impedance of the line structure shown in FIG. 5. Therefore, the total height 2H of the entire Y-shaped dipole antenna will be shorter than the length $$\frac{\lambda_g}{2}$$

of a conventional dipole antenna. Further, according to the theory of mirror, the Y-shaped dipole antenna in FIG. 7 can be modified to be the Y-shaped monopole antenna shown in FIG. 8. The monopole antenna 80", as shown in FIG. 8, comprises a feed-line 81, a primary radiating element L2, a tuning element L1 and a ground plane layer 84". In the monopole antenna 80", the tuning element L1 (which comprises two stubs forming a V-shape) is used to reduce the overall length of the antenna and to generate the current in two directions from the plane on which the antenna being placed so as to provide all-directional radiation features. If the vertical line L2 shown in FIG. 8 can be bent as in FIG. 9, the size of the antenna will be reduced more.

Figure 6:
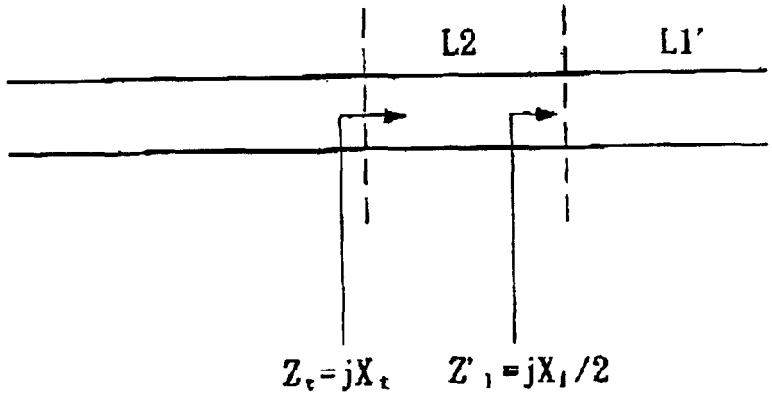
FIG. 6 is a diagram showing an equivalent open transmission line of the configuration shown in FIG. 5.

As described, the input impedance in FIG. 5 is same as the one in FIG. 6, meaning $$\frac{Z_1}{2} = Z_1', \text{ or } -\frac{j}{2}Z_0 \cot\beta L1 = -jZ_0 \cot\beta L1'.$$

Wherein $$\beta = \frac{2\pi}{\lambda_g},$$

that is so called the phase constant of line. It can be further derived to be $$\beta L1' = \cot^{-1}\left(\frac{\cot\beta L1}{2}\right),$$

when resonance occurred, it should satisfy $$\beta(L1' + L2) = \beta\left(\frac{\lambda_g}{4}\right) = \left(\frac{2\pi}{\lambda_g}\right)\left(\frac{\lambda_g}{4}\right) = \frac{\pi}{2},$$

therefore, $$\beta L2 = \frac{\pi}{2} - \beta L1' = \frac{\pi}{2} - \cot^{-1}\left(\frac{\cot\beta L1}{2}\right),$$

Let $$f(\beta L1) = \beta L1 + \beta L2 = \beta L1 + \frac{\pi}{2} - \cot^{-1}\left(\frac{\cot\beta L1}{2}\right),$$

which is proportional to the total line length (L1+L2) of the Y-shape monopole. A proper βL1 will derive a minimum value of f(βL1). After simple calculation, the minimum value of f(βL1) is 1.23, meaning the minimum value of L1+L2 is $$\frac{1.23}{\beta} = \left(\frac{1.23}{2\pi}\right)\lambda_g, \text{ or } 0.196\ \lambda_g.$$

Figure 1:
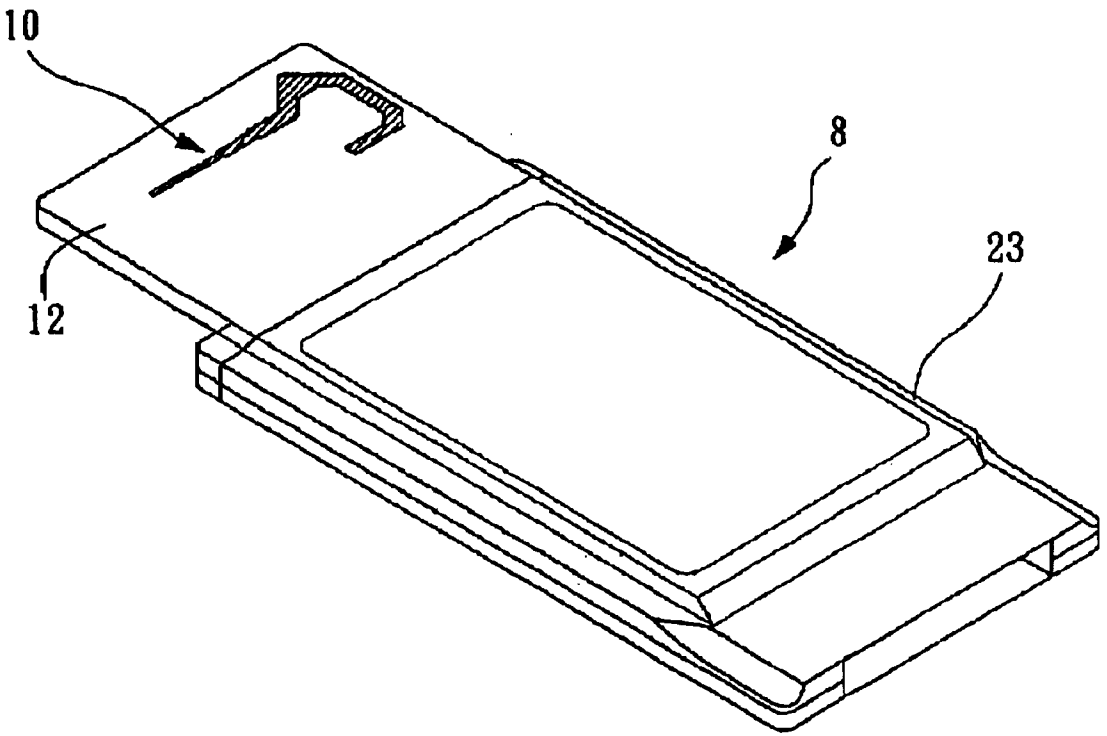
FIG. 1 (PRIOR ART)
FIG. 1 is a diagram showing a conventional wireless network interface card.
Figure 2:
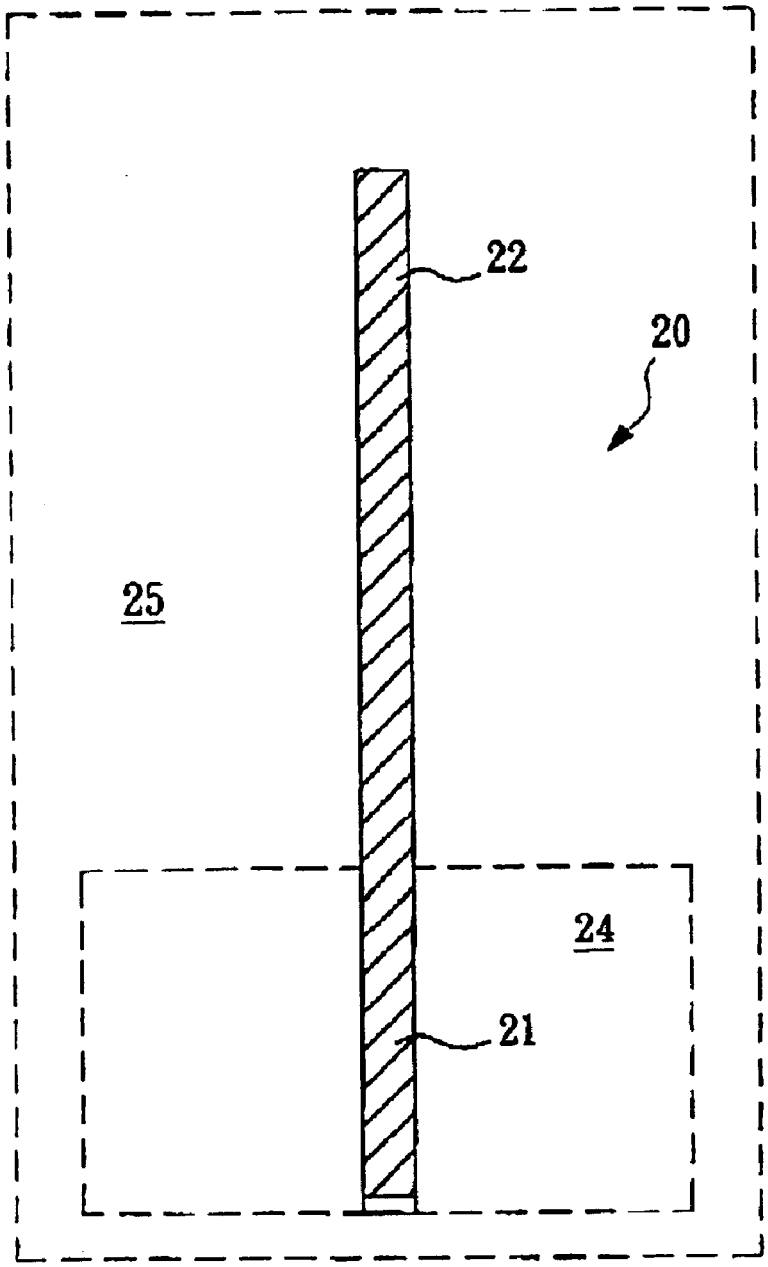
FIG. 2 (PRIOR ART)
FIG. 2 is a schematic diagram showing a conventional Printed Monopole Antenna.
Figure 3:
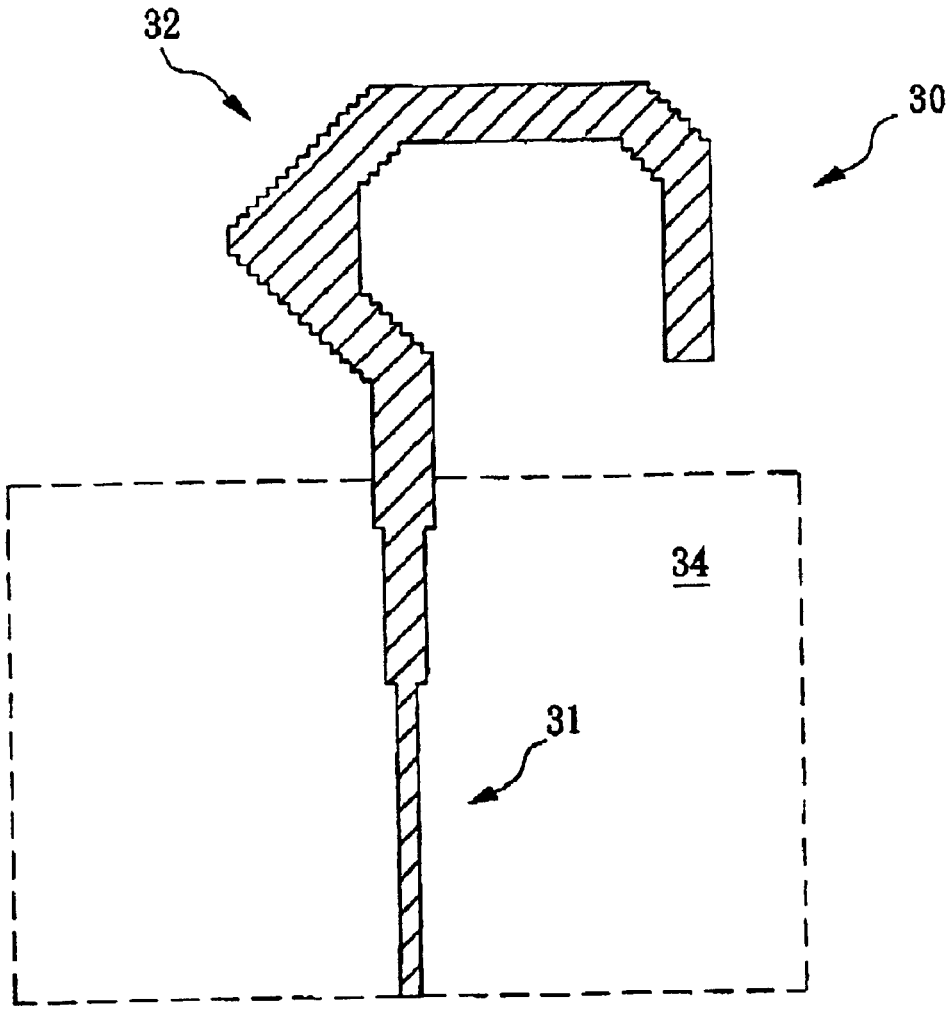
FIG. 3 (PRIOR ART)
FIG. 3 is a schematic diagram showing a conventional printed monopole antenna of U.S. Pat. No. 6,008,774.

So, the minimum length (L1+L2) of the Y-shaped monopole antenna can be $0.196\lambda_g$. Comparing with the length $$\left(\frac{\lambda_g}{4}\right)$$

of a conventional monopole antenna (shown in FIG. 2), the length of the Y-shaped monopole antenna according the present invention is about $$\frac{0.196\lambda_g}{0.25\lambda_g} \approx 78.4\% \text{ of it.}$$

For example, with the center frequency 2.45 GHz and the dielectric constant 4.4, the length of the Y-shaped monopole antenna according to the present invention can be reduced from 2.32 cm as a conventional one to 1.92 cm. Moreover, if the vertical line of the antenna can be bended as in FIG. 9, the size of the antenna can be further reduced extremely.

Figure 9:
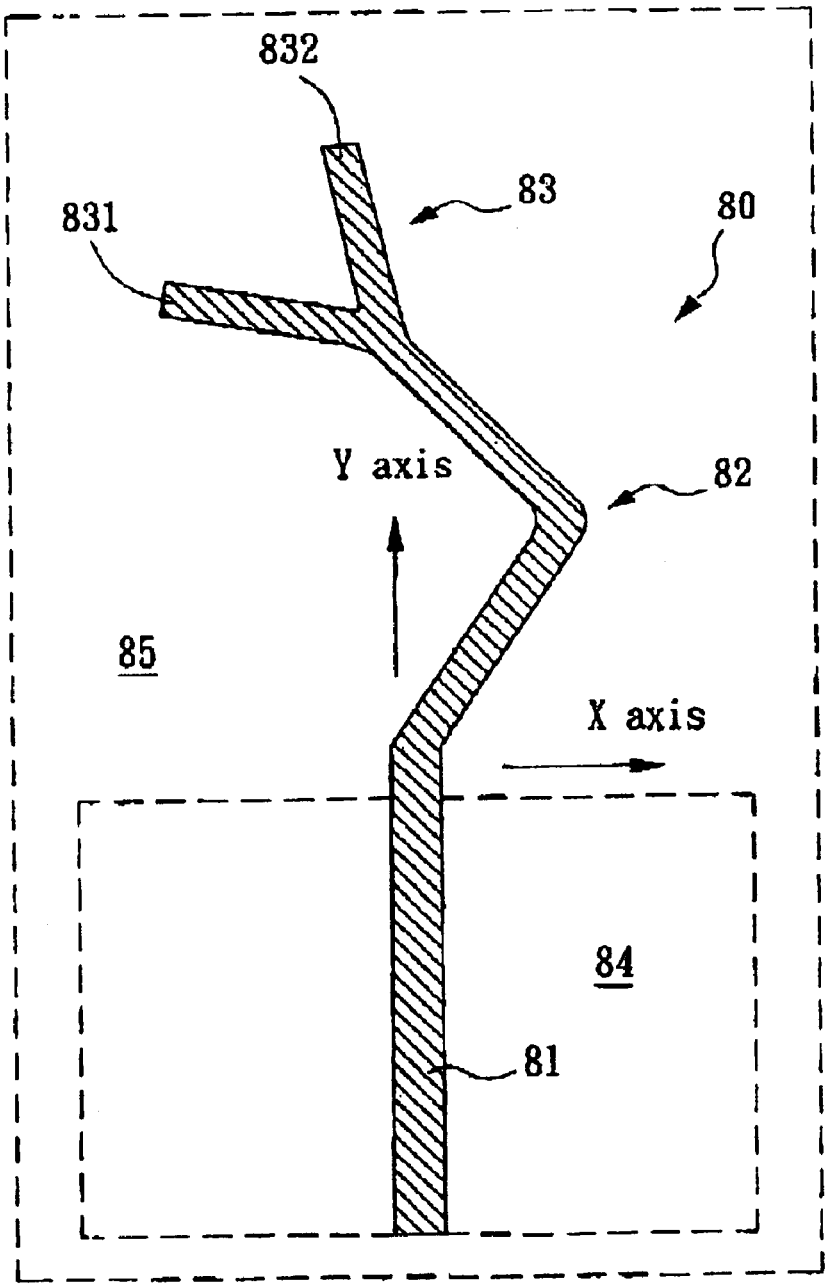
FIG. 9 is a diagram showing an embodiment of the printed antenna according to the present invention.

FIG. 9 is a diagram showing an embodiment of the printed antenna according to present invention. As shown, the printed antenna 80 comprises a feed-line 81, a primary radiating element 82, a tuning element 83, a ground plane layer 84 and a dielectric layer 85 (for example, a circuit board made of dielectric material). The feed-line 81, primary radiating element 82, tuning element 83 and ground plane layer 84 are all made of electrically conductive materials such like copper, nickel or gold. The dielectric constant of the dielectric layer 85 is $\in_1$, the regular value thereof is about 4.4. The dielectric layer 84 (e.g. circuit board) has a bottom surface (the first surface) and a top surface (the second surface). These two surfaces are spaced apart from and substantially parallel to each other. The ground plane layer 84 covers some portion of the bottom surface of the dielectric layer 85 The feed-line 81 is on the top surface of the dielectric layer 85 and extends over the ground plane layer 84. One end of the feed-line 81 is connected electrically to a driving circuitry (not shown in figures). One end of the primary radiating element 82 is connected electrically to another end of the feed-line 81 for emitting and receiving wireless signals. The shape of the primary radiating element 82 can be any kind so that it can be line-shaped, V-shaped, or curve-shaped. The tuning element 83 is connected electrically to another end of the primary radiating element 82 for adjusting the size and the center frequency $f_0$ of the antenna.

The characteristic of the present invention is that, the tuning element 83 of the present invention flirter comprises at least two stubs 831, 832. Each one of the stubs 831, 832 has a fixed end and a free end respectively. The fixed ends of the stubs 831, 832 are electrically connected to each other and further electrically connected to the primary radiating element 82. The stubs 831, 832 can be formed a line-shaped, V-shaped, inverted V-shaped or clamp-shaped structure. For example, the combination of the V-shaped structure of stubs 831, 832 and the primary radiating element 82 forms the Y-shaped monopole printed antenna 80 of the present invention. So the printed antenna 80 of the present invention can form the T-shaped, Y-shaped, arrowhead-shaped or clamp-shaped structure.

Figure 10:
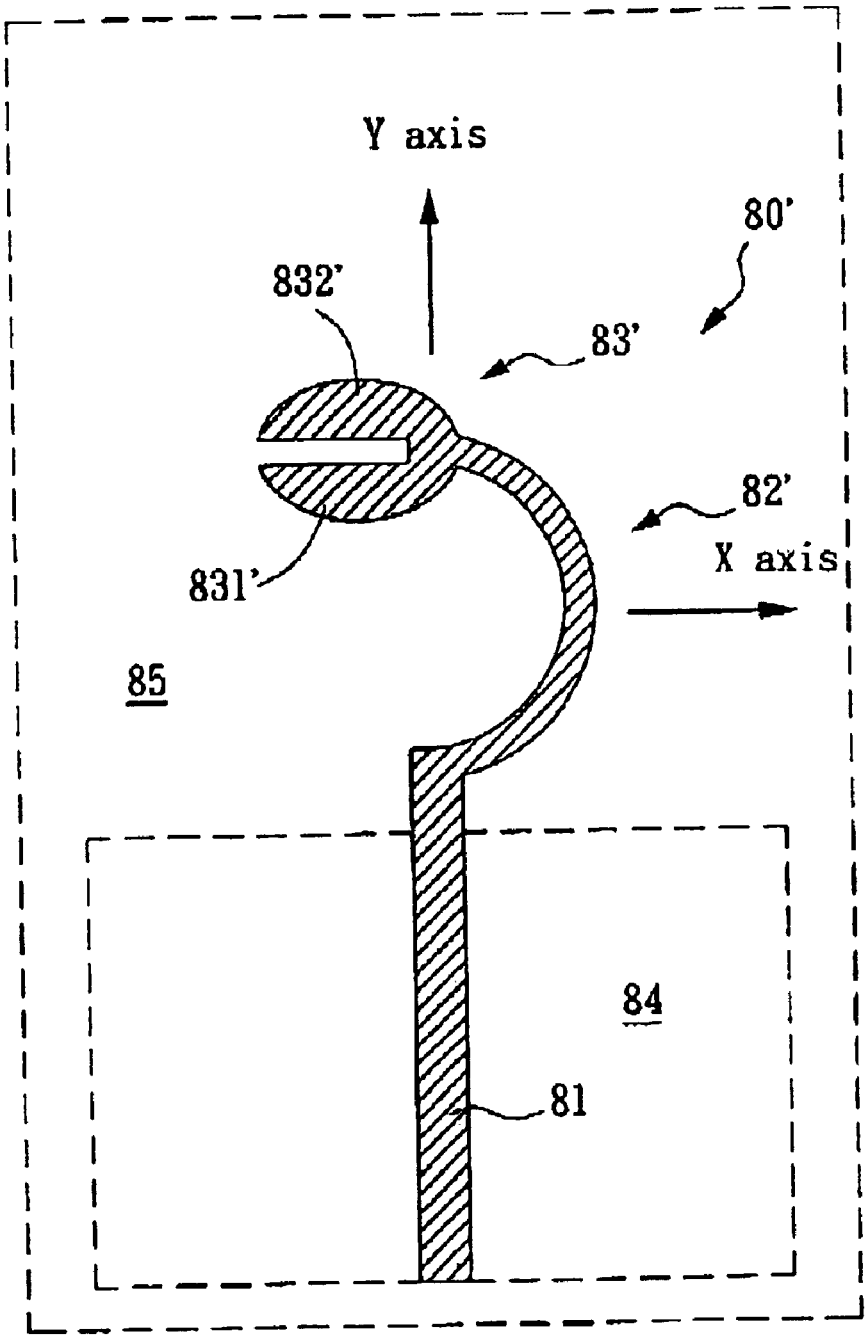
FIG. 10 is a diagram showing another embodiment of the printed antenna according to the present invention.
Figure 11A:
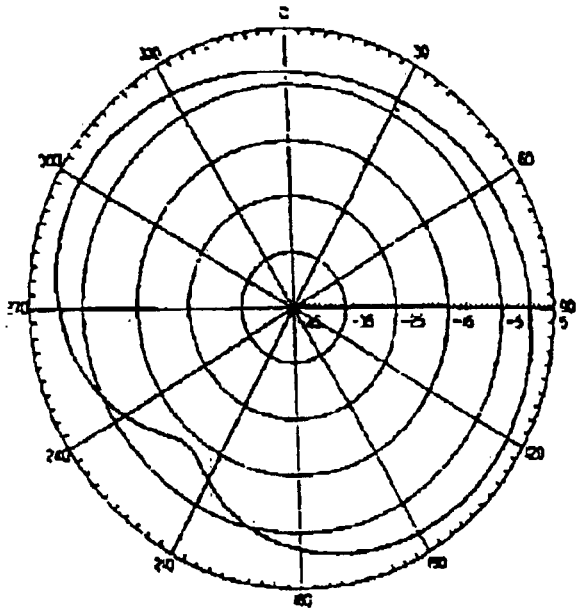
FIGS. 11A~11F are plots of computed radiation patters showing the gain distributions of a particular embodiment of the printed antenna according to present invention.
Figure 11B:
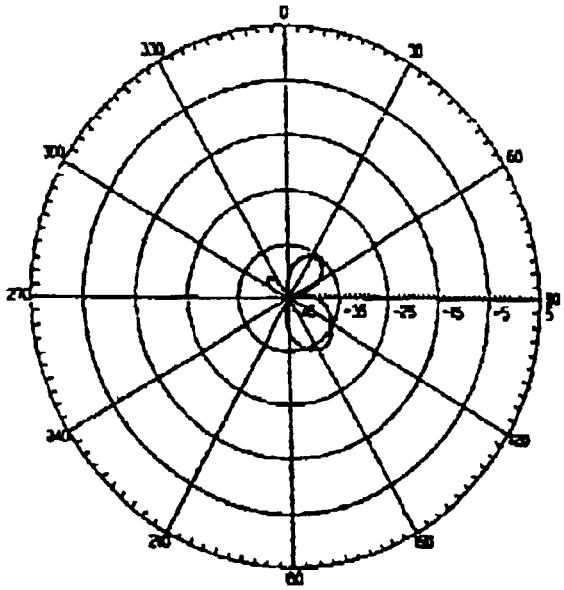
Figure 11C:
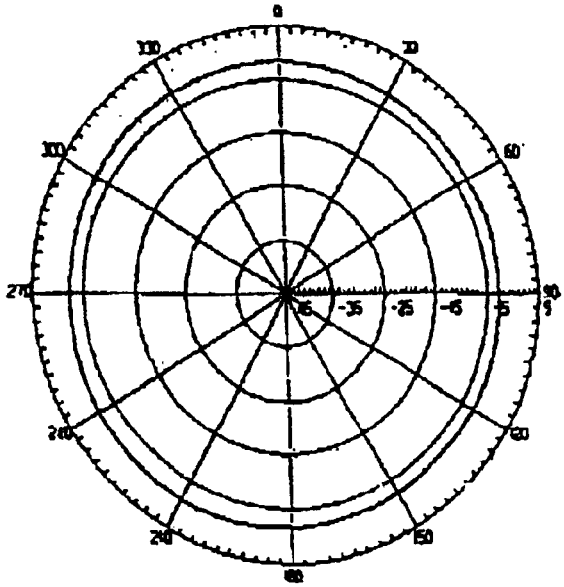
Figure 11D:
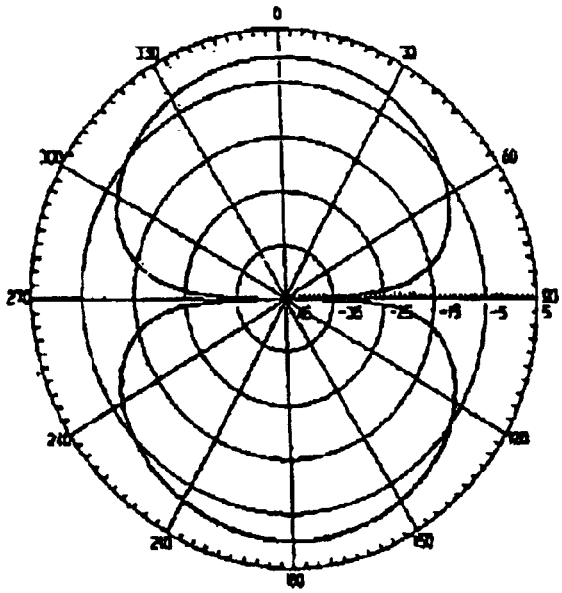
Figure 11E:
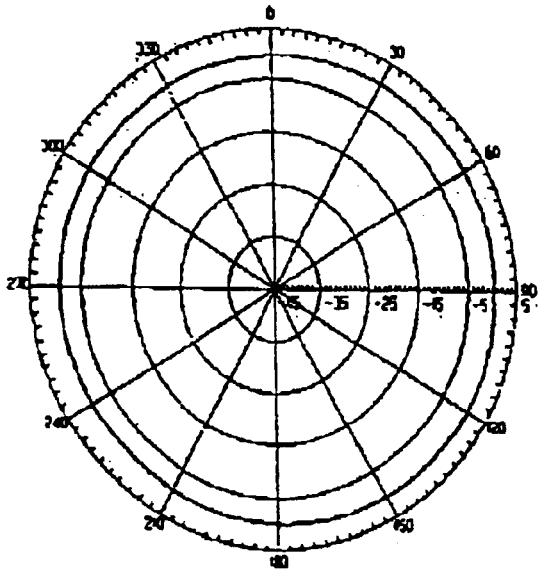
Figure 11F:
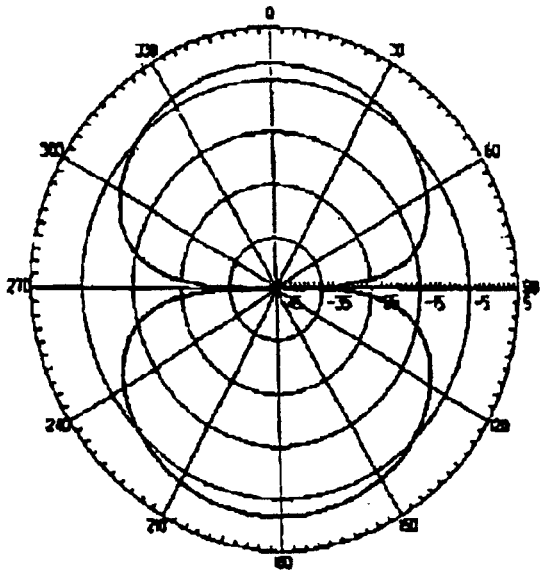

FIG. 10 is a diagram showing another embodiment of the printed antenna 80' according to present invention. As shown, the main radiating element 82' now is a curve-shaped structure with substantially equal width and the tuning element 83' is changed to a substantially clamp-shaped structure. That is, the two stubs 831', 832' of the tuning element 83' are substantially parallel to each other having their fixed ends connected to each other but their free ends spaced apart from each other so as to form the substantially clamp-shaped structure.

FIGS. 11A~11F are plot diagrams showing the gain distribution of the electric field components $E_{100}$ and $E_{74}$ of the clamp-shaped monopole printed antenna according to the present invention, in which the center frequency of the signal is 2450 MHz. The reference coordinates for FIG. 11 are shown in FIG. 10, and the Y-axis is the extending direction of the feed-line 81.

Figure 12:
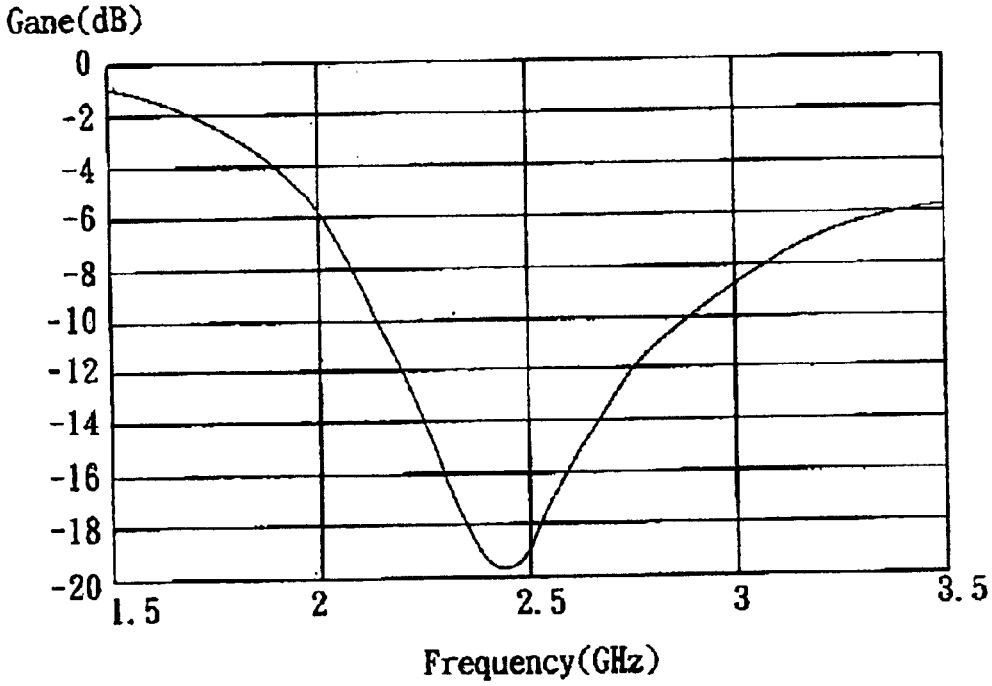
FIG. 12 is a plot showing the relationship between the return loss and the frequency of the printed antenna according to present invention.

FIG. 12 is a plot diagram showing the relationship between the return loss and the frequency of the clamp-shaped monopole printed antenna according to present invention, Although this invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A method for designing a printed antenna structure for transmission of a spectrum of electromagnetic waves having a wavelength $\lambda_g$ at the center frequency $f_0$, wherein $$\lambda_g = \frac{1}{\sqrt{\varepsilon_{re}}} * \frac{c}{f_0},$$

c is the speed of light, $f_0$ is the center frequency of electromagnetic waves, and $\in_{re}$ is the equivalent dielectric constant, said method comprising:

assuming an open transmission line for transmission of the electromagnetic waves with the wavelength $\lambda_g$ having a length L, and $L=\lambda_g/4$, wherein the input impedance of the open transmission line is $jX_t$, $Z_0$ is the characteristic impedance of the transmission line and $jX_t=-jZ_0\cot(2\pi L/\lambda_g)$;

preparing the printed antenna structure, said printed antenna structure comprising a primary radiating element and a tuning element electrically connected to one end of the primary radiating element, said primary radiating element having an overall length of L2, said tuning element comprising two stubs, each one of the stubs having a length of L1 and including a free end spaced apart from each other and a fixed end connected to the primary radiating element, wherein the overall input impedance of the combination of the primary radiating element and the tuning element is also equal to $jX_r$;

$$\text{assuming } f(\beta L1) = \beta L1 + \beta L2 = \beta L1 + \frac{\pi}{2} - \cot^{-1}\left(\frac{\cot\beta L1}{2}\right),$$

$$\text{wherein } \beta = \frac{2\pi}{\lambda_g}; \text{ and}$$

calculating the values of L1 and L2 for obtaining a minimum value of f(βL1), and using the calculated L1 and L2 to design the printed antenna structure.

2. The method as recited in claim 1, wherein the printed antenna further comprises:

a circuit board of dielectric material having a first surface and a second surface which is spaced apart from and substantially parallel to said first surface;

a ground plane layer of electrically conductive material covering a portion of the first surface of the circuit board; and a feed-line of electrically conductive material connected to the primary radiating element and disposed on the second surface of the circuit board so as to extend over the ground plane layer;

wherein the primary radiating element and the tuning element are both made of electrically conductive material and disposed on the second surface so as not to extend over the ground plane layer.

3. The method as recited in claim 1, wherein $L1+L2<\lambda_g/4$.

4. A printed antenna comprising:

a primary radiating element and a tuning element electrically connected to one end of the primary radiating element, said primary radiating element having an overall length of L2, said tuning element further comprising two stubs, the stubs each having a length of L1 and including free ends spaced apart from each other, an fixed ends connected to the primary radiating element, wherein the overall input impedance of the combination of the primary radiating element and the tuning element is equal to $jX_1$, wherein $jX_1$ is calculated by assuming an open transmission line for transmission of the electromagnetic waves with the wavelength $\lambda_g$ having a length L, where $L=\lambda_g/4$, wherein the input impedance of the open transmission line is $jX_1$, $Z_0$ is the characteristic impedance of the transmission line and $jX_1=jZ_0\cot(2nL/\lambda_g)$; and the values of L1 and L2 for obtaining a minimum value of ∫(βL1) are calculated by the equation:

$$f(\beta L1) = \beta L1 + \beta L2 = \beta L1 + \frac{\pi}{2} - \cot^{-1}\left(\frac{\cot\beta L1}{2}\right), \quad \text{wherein } \beta = \frac{2\pi}{\lambda_g};$$

wherein the printed antenna structure transmits a spectrum of electromagnetic waves having a wavelength $\lambda_g$ at a center frequency $f_0$, wherein $$\lambda_g = \frac{1}{\sqrt{\varepsilon_{re}}} * \frac{c}{f_0},$$

c is the speed of light, $\int_0$ is the center frequency of electromagnetic waves, and $\in_{re}$ is the equivalent dielectric constant.

5. The printed antenna as recited in claim 4, further comprising:

a) a circuit board of dielectric material having a first surface and a second surface which is spaced apart from and substantially parallel to said first surface;

b) a ground plane layer of electrically conductive material covering a portion of the first surface of the circuit board; and c) a feed-line of electrically conductive material connected to the primary radiating element and disposed on the second surface of the circuit board so as to extend over the ground plane layer;

wherein the primary radiating element and the tuning element are both made of electrically conductive material and disposed on the second surface so as not to extend over the ground plane layer.

6. The printed antenna as recited in claim 4, wherein $L1+L2<\lambda_g/4$.

7. The printed antenna as recited in claim 4, wherein the primary radiating element and the two stubs form a Y-shaped monopole printed antenna.

8. The printed antenna as recited in claim 4, wherein the primary radiating element and the two stubs form a clamp-shaped monopole printed antenna.

9. The printed antenna as recited in claim 4, wherein the two stubs are both linear.

10. The printed antenna as recited in claim 4, wherein the two stubs are substantially parallel to each other having their fixed ends connected to each other but their free ends spaced apart from each other so as to form a substantially clamp-shaped structure.

11. The printed antenna as recited in claim 4, wherein the two stubs form a V-shaped structure.

12. The printed antenna as recited in claim 4, wherein the primary radiating element is a curved structure with substantially equal width.

* * * * *